US006763592B2

(12) United States Patent
Yu

(10) Patent No.: US 6,763,592 B2
(45) Date of Patent: Jul. 20, 2004

(54) FOLDING KNIFE

(76) Inventor: Li Yu, 8-102, Block 4, No. 3 Dongmen North Road, Shenzhen, Guangdong Province (CN), 518001

( * ) Notice: Subject to any disclaimer, the term of this patent is extended or adjusted under 35 U.S.C. 154(b) by 4 days.

(21) Appl. No.: 10/336,578

(22) Filed: Jan. 3, 2003

(65) Prior Publication Data

US 2003/0126746 A1 Jul. 10, 2003

(30) Foreign Application Priority Data

Jan. 4, 2002 (CN) ..... 02201402 U

(51) Int. Cl.[7] ..... B26B 1/04
(52) U.S. Cl. ..... 30/161; 30/160
(58) Field of Search ..... 30/161, 151, 160

(56) References Cited

U.S. PATENT DOCUMENTS 4,811,486 A * 3/1989 Cunningham ..... 30/161
5,769,094 A * 6/1998 Jenkins et al. ..... 30/161
6,138,363 A * 10/2000 Kawashima ..... 30/151
6,397,477 B1 * 6/2002 Collins ..... 30/161
6,427,334 B2 * 8/2002 Onion ..... 30/161
6,487,740 B2 * 12/2002 Seber et al. ..... 7/128
6,523,265 B2 * 2/2003 Eickhorn ..... 30/161

* cited by examiner

*Primary Examiner*—Charles Goodman
(74) *Attorney, Agent, or Firm*—Slater & Matsil, L.L.P.

(57) ABSTRACT

A folding knife having a blade and handle further includes a sheath which receives the exposed edge and knife point of the blade in an accommodating slot. A leaf spring in registry with the accommodating slot has a locking face that locks the blade into place and an unlocking face that releases the blade when the handle is rotated about the locked blade, thus allowing the knife to be released from the sheath in an open position. By use of the sheath, the blade can be double edged and can be longer than the handle.

20 Claims, 3 Drawing Sheets

FOLDING KNIFE

TECHNICAL FIELD

The present invention relates to a knife, and more specifically to a folding knife.

BACKGROUND ART

Typically, a conventional folding knife includes a blade and a handle connected thereto by a pivot axis. The blade has an edge, which can be folded and concealed in the handle, and a knifepoint formed at the end opposite the pivot axis. The conventional folding knife so constructed that the blade thereof is concealed in the handle, with one edge of the blade being received within the handle, but typically the other edge is exposed. As a result, the length of the blade has to be less than that of the handle, and only one sharpened edge can be formed on the blade, which limits the utility of the folding knife.

SUMMARY OF THE INVENTION

An advantageous feature of the preferred embodiments of the present invention is to provide a folding knife with a blade longer than the handle and double sharpened edges.

In one aspect, the present invention provides for a folding knife, comprising a blade pivotably attached to a handle by a pivot axis. The blade includes at least one locating projection and a locking projection. The handle includes an unlocking unit. The folding knife also includes a sheath, which includes an accommodating slot that receives therein said blade, a locating slot which receives therein the at least one locating projection, and a leaf spring provided within the sheath and aligned with said accommodating slot. The leaf spring is attached to the sheath and has a first end including a locking face, the locking face engaging the locking projection when the blade is inserted in said accommodating slot, and an unlocking face aligned to be engaged by the unlocking unit when the handle is rotated about the pivot axis.

The invention may further provide for a folding knife wherein the first end of the leaf spring comprises a wedge-shaped block, with one face of said block being the locking face and a second face of the block being the unlocking face. The unlocking unit is an unlocking projection and the thickness of the locking projection is no greater than the thickness of the wedge-shaped block or the unlocking unit is a lateral pin and the thickness of the lateral pin is no greater than the thickness of the wedge-shaped block.

The invention may further provide for a grip, a first end of the grip forming a shearing sheet and being rotatably attached to the sheath and to a shearing seat having a shearing blade by a shearing axis. The folding knife may further provide for a locking frame pivotably attached to the sheath and having an end that engages with and locks in place a second end of the grip, wherein the leaf spring has a second end that engages with and is elastically deformed by the grip when the grip is in a closed position.

In another aspect, the present invention provides for a folding knife comprising a blade pivotably attached to a handle at one end, having a point at another end, and having at first and second edge, wherein said first edge is received within said handle when said blade is in a closed position. The invention further provides for a a sheath, having a first slot for receiving therein said second edge of said blade and including a leaf spring in registry with said slot, the leaf spring including a locking face that engages with and locks into place said blade when said second edge is inserted into said slot, the leaf spring further including an unlocking face that engages with said handle, when said handle is rotated about said blade, wherein said locking face is disengaged from said blade when said handle engages with said unlocking face.

DETAILED DESCRIPTION OF THE PREFERRED EMBODIMENTS

Figure 1:
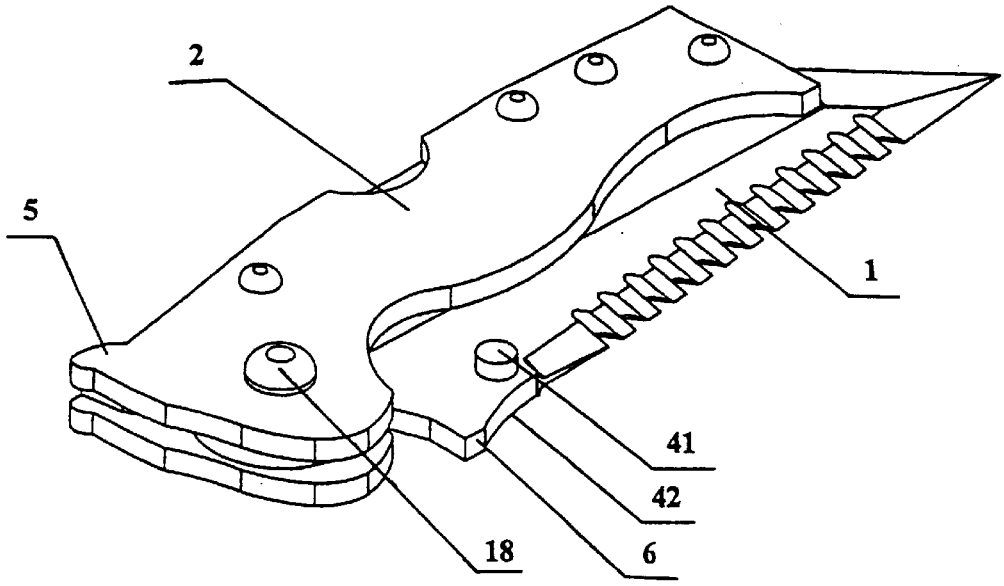
FIG. 1 is a perspective view of a preferred embodiment blade and the handle.

The preferred embodiments of the present invention will be described in detail with reference to the accompanying drawings. It should be appreciated, however, that the present invention provides many applicable inventive concepts that can be embodied in a wide variety of specific contexts. The specific embodiments discussed are merely illustrative of specific ways to make and use the invention, and do not limit the scope of the invention. For ease of reference, common reference numerals will be used throughout the figures when referring to the same or similar features common to the figures.

Figure 2:
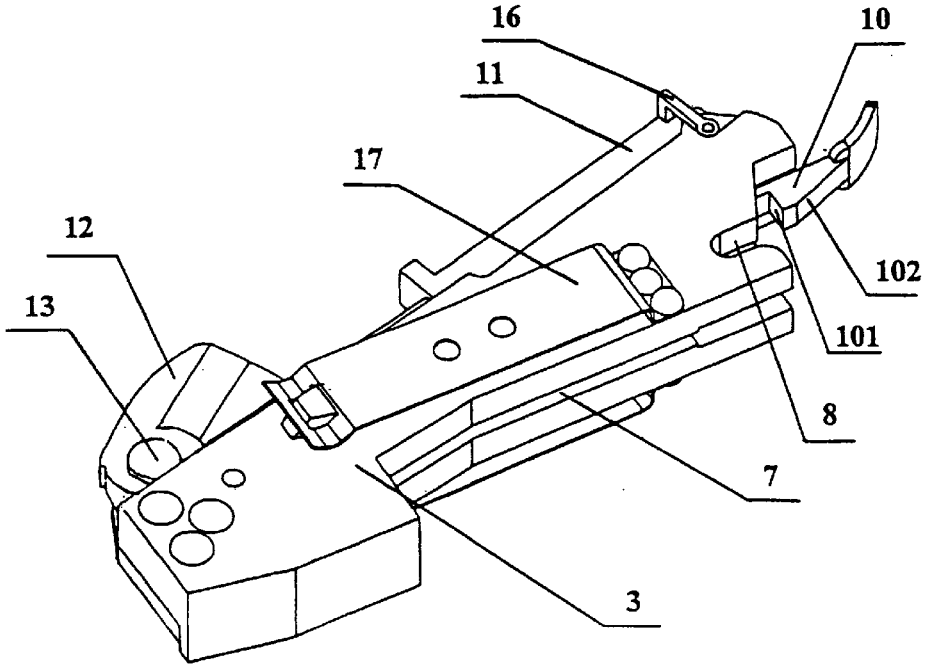
FIG. 2 is a perspective view of a preferred embodiment sheath.
Figure 3:
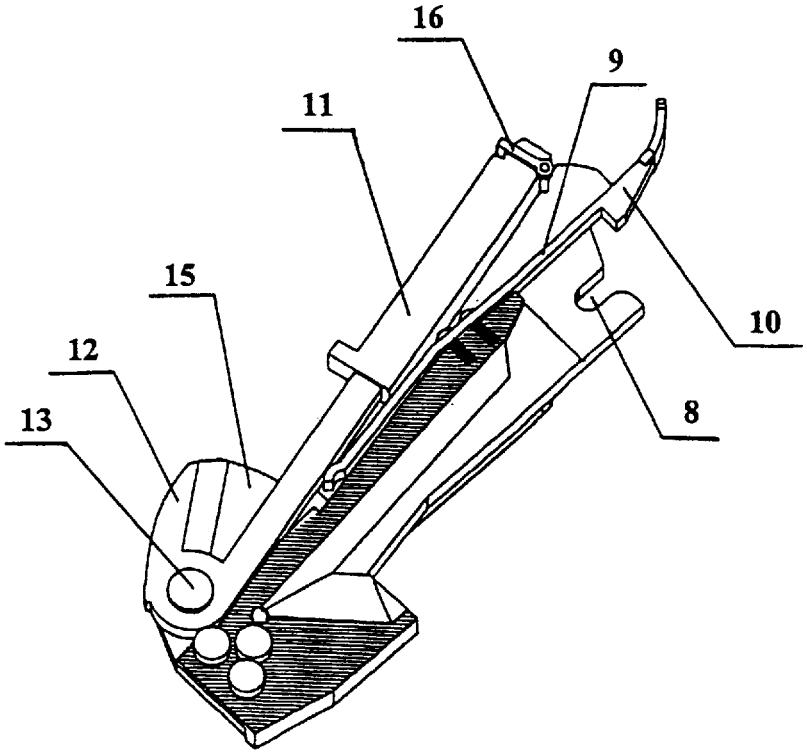
FIG. 3 is a partially cross-sectioned perspective view showing a preferred embodiment leaf spring of the sheath.
Figure 4:
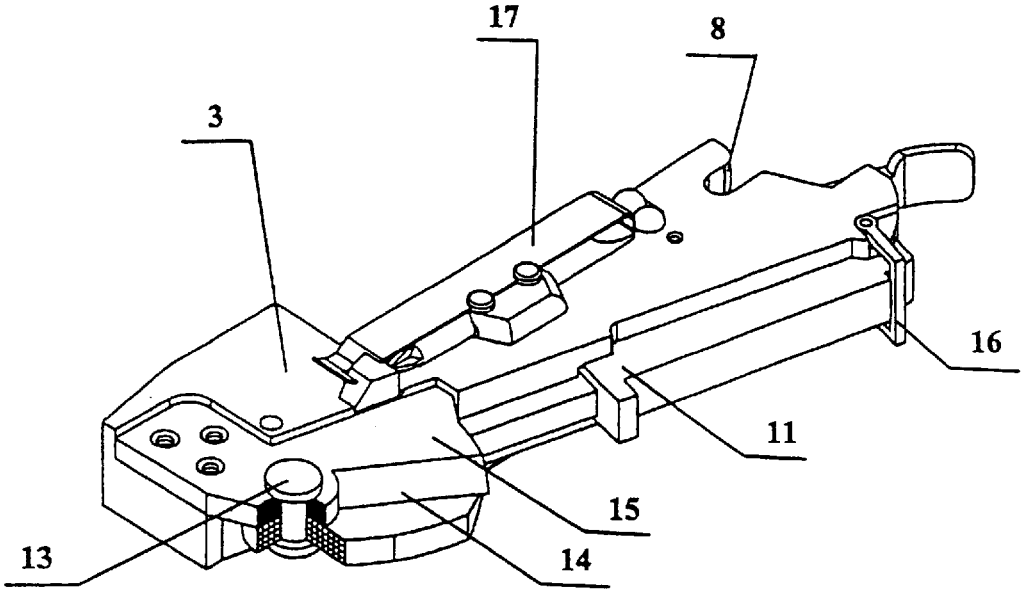
FIG. 4 is a partially cross-sectioned perspective view showing a preferred embodiment grip of the sheath and shearing mechanism.

As shown in FIGS. 1, 2, 3, 4, 5, and 6, a folding knife according to the preferred embodiments of the present invention comprises a blade 1 and handle 2 (FIG. 1) and a sheath (FIG. 3). The blade 1 is connected to the handle 2 by a pivot axis 18. As best illustrated in FIG. 1, in the folded position, one edge of the blade 1 is concealed within the handle 2, while the other blade is exposed. Also shown in FIG. 1 are locating projections 41 and 42 provided on blade 1. These projections are received within locating slot 8 of sheath 3 (FIG. 2), as will be described in further detail below.

A locking projection 6 is formed on blade 1 near the end where blade 1 is connected to handle 2 via pivot axis 18. An unlocking unit, such as for example an unlocking projection 5 (FIG. 1) or a lateral pin 51 (FIG. 5), is provided on the outer surface of handle 2 at the end where handle 2 is connected to blade 1. The purpose of locking projection 6 and unlocking unit 5 or 51 will be described in greater detail below.

Note that in the preferred embodiment, the length of blade 1 exceeds the length of handle 2 and that, even in the folded position, blade 1 is not fully concealed, or received, within handle 2. Thus, the knife point remains exposed—and a potential hazard—even when blade 1 is in the folded position. Likewise, because the preferred embodiment blade has a sharpened cutting surface on both edges of the blade, a cutting surface remains exposed, even when the blade is in the folded position, i.e., received within handle 2. Although a double-bladed knife and a knife that is longer than the handle are not requirements of the present invention, these aspects of the preferred embodiments highlight advantageous features of the invention. This is because, unlike folding knives using conventional technology, the long, double-edged blade 1 can be handled and carried safely while in the folded position, as further described below.

Turning now to preferred embodiment sheath 3 as illustrated in FIG. 2. Sheath 3 includes an accommodating slot 7 that mates with and receives the exposed portion of blade 1 when blade 1/handle 2 is inserted into the sheath. Hence, when the blade/handle is inserted into sheath 3, the cutting surfaces of blade 1 that are not covered by handle 2, including the exposed sharpened edge and the knife point, are covered by sheath 3, thus making the knife safe for handling.

Figure 6:
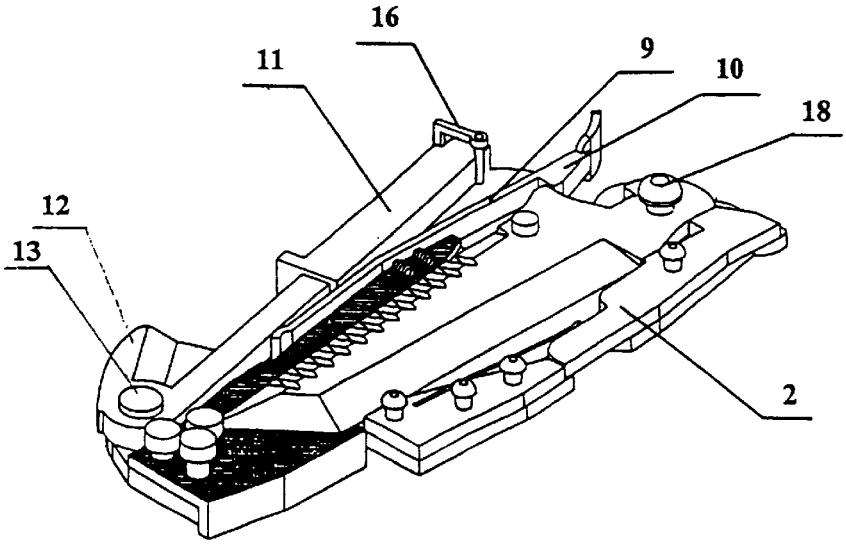
FIG. 6 is a partially cross-sectioned perspective view of a preferred embodiment blade and handle engaged in a preferred embodiment sheath.

Grip 11 is pivotably attached to sheath 3 via shearing axis 13. One end of grip 11 terminates in a curved portion that forms a shearing sheet 12, as best illustrated in FIGS. 2 and 6. Shearing sheet 12 cooperates with shearing seat 15, which has a shearing blade 14 to form a shears or scissors. Shearing action is achieved between the shearing blades by moving grip 11 between an open and closed position, relative to the body of sheath 3. In the preferred embodiments, grip 11 can be locked in a closed position by a locking mechanism, such as rotatable locking frame 16 formed on sheath 13. As best illustrated in FIGS. 2 and 6, locking frame 16 is preferably a u-shaped frame, pivotably mounted to sheath 3 at the open end of the frame, wherein the closed end of the frame can slide over and engage the free end of grip 11, thus locking grip 11 into the closed position.

A leaf spring 9 is contained within the interior of sheath 3, as best illustrated in partial cross-sectioned FIG. 3. This leaf spring is positioned between the back side of accommodating slot 7 and grip 11. The center of leaf spring 9 is affixed to sheath 3. When grip 11 is held in the closed position, it abuts against and partially deforms the end of leaf spring 9. The elastic restoring force of leaf spring 9 results in an outward force against the grip 11. As described above, grip 11 is held in the closed position, despite the outward force of leaf spring 9, when locking frame 16 is engaged with the end of grip 11.

Figure 5:
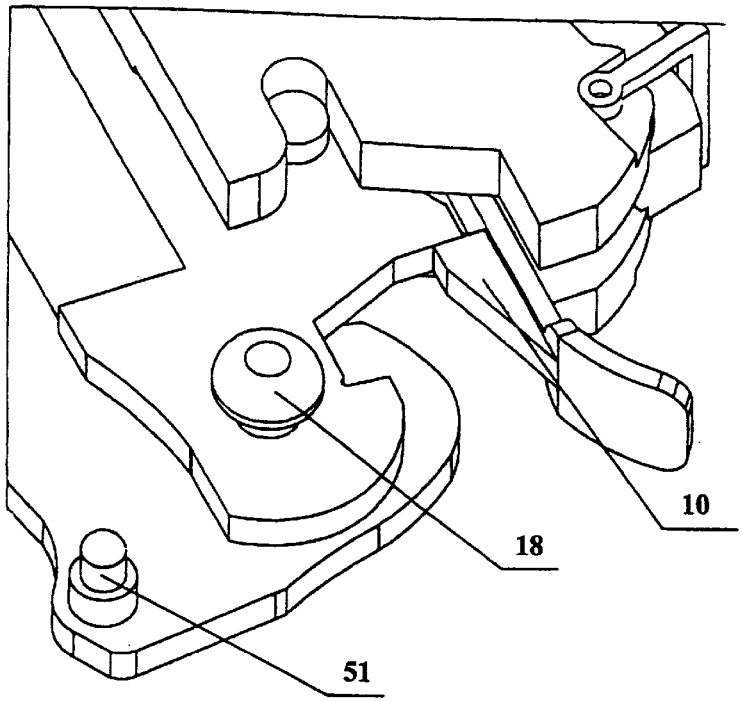
FIG. 5 is a perspective view showing details of a preferred embodiment unlocking unit wherein a lateral pin is used as the unlocking unit.

The other end of leaf spring 9 extends in a direction opposite to the knifepoint of blade 1, when the blade is engaged in sheath 3. This other end of leaf spring 9 has a wedge-shaped locking/unlocking block 10 formed thereon, as illustrated in FIGS. 3 and 5. One skilled in the art will recognize that variations on the geometry of block 10 are possible and that the illustrated wedge shape is only one of many design possibilities. When the blade 1/handle 2 combination is engaged in sheath 3, the otherwise exposed edge of blade 1 that is received in accommodating slot 7 engages with leaf spring 9. As blade 1 is received within accommodating slot 7, locking projection 6 on blade 1 mates with locking face 101 of wedge-shaped block 10, as illustrated in FIGS. 5 and 6. The elastic restoring force of leaf spring 9 will keep locking face 101 engaged with locking projection 6, hence securing and locking knife 1/handle 2 within sheath 3. Preferably, the thickness of locking projection 6 is less than or equal to that of the wedge-shaped block 10. This will ensure that, as described below, leaf spring 9 can be sufficiently deformed so as to release locking projection 6 from locking face 101. As illustrated in FIG. 5, locating projections 41, 42 on blade 1 engage with and are received by locating slot 8 on sheath 3 when the blade in placed within sheath 3.

To release the blade 1/handle 2 combination from sheath 3, handle 2 is rotated about pivot axis 18 until unlocking projection 5 (or lateral pin 51) on handle 2 engages with unlocking face 102 (FIG. 2) of wedge-shaped block 10. This is possible even though blade 1 is secured within sheath 3 by the action of locking face 101 on locking projection 6. The pressure of unlocking projection 5 (or lateral pin 51) against unlocking face 102 elastically deforms leaf spring 9, thus disengaging locking face 101 from locking projection 6 and hence freeing blade 1/handle 2 combination from sheath 3. In this way, blade 1 is in its unfolded position and ready to be used as soon as it is removed from sheath 3.

In some preferred embodiments, blade 1/handle 2 combination can be disengaged from sheath 3 without rotating the blade 1/handle 2. This is accomplished by manually pushing against unlocking face 102 with, e.g., the user's thumb. As illustrated in FIG. 5, leaf spring 9 preferably has a flattened end region to allow for this operation. Once blade 1/handle 2 is removed, blade 1 will need to be unfolded to its open position prior to use. Also illustrated in FIG. 2 is belt clip 17, by which sheath 3 (and when engaged, blade 1/handle 2 combination) can be attached to a user's belt or other convenient article of clothing, and the like.

In the foregoing specification, the invention has been described with reference to specific embodiments. However, various modifications and changes can be made by one skilled in the art without departing from the scope of the present invention. Accordingly, the specification and figures are to be regarded in an illustrative rather than a restrictive sense, and all such modifications are intended to be included within the scope of the present invention.

I claim:

1. A folding knife, comprising:

a blade pivotably attached to a handle by a pivot axis, the blade including at least one locating projection and a locking projection;

the handle including an unlocking unit; and a sheath, including an accommodating slot that receives therein said blade;

a locating slot which receives therein said at least one locating projection;

a leaf spring provided within said sheath and aligned with said accommodating slot, the leaf spring being attached to said sheath and having a first end including:

a locking face, the locking face engaging said locking projection when said blade is inserted in said accommodating slot; and an unlocking face aligned to be engaged by said unlocking unit when said handle is rotated about said pivot axis.

2. The folding knife of claim 1 wherein said first end of said leaf spring comprises a wedge-shaped block, one face of said block being said locking face and a second face of said block being said unlocking face.

3. The folding knife of claim 2 wherein said unlocking unit is an unlocking projection and the thickness of said locking projection is no greater than the thickness of the wedge-shaped block.

4. The folding knife of claim 1 wherein said unlocking unit is a lateral pin and the thickness of the lateral pin is no greater than the thickness of the wedge-shaped block.

5. The folding knife of claim 1 further comprising:

a grip, a first end of said grip forming a shearing sheet and being rotatably attached to said sheath and to a shearing seat having a shearing blade by a shearing axis; and a locking frame pivotably attached to said sheath and having an end that engages with and locks in place a second end of said grip;

wherein said leaf spring has a second end that engages with and is elastically deformed by said grip when said grip is in a closed position.

6. The folding knife of claim 1 wherein said blade has two sharpened edges.

7. The folding knife of claim 1 wherein the length of said blade exceeds the length of said handle.

8. The folding knife of claim 1 further including a belt clip.

9. The folding knife of claim 1 wherein said leaf spring further includes a flattened region whereby a user can manually deform said leaf spring.

10. A folding knife comprising:

a blade pivotably attached to a handle at one end, having a point at another end, and having a first and second edge, wherein said first edge is received within said handle when said blade is in a closed position;

a sheath, having a first slot for receiving therein said second edge of said blade, and including a leaf spring in registry with said slot, the leaf spring including a locking face that engages with and locks into place said blade when said second edge is inserted into said slot, the leaf spring further including an unlocking face that engages with said handle, when said handle is rotated about said blade, wherein said locking face is disengaged from said blade when said handle engages with said unlocking face.

11. The folding knife of claim 10 further comprising locating projections on said blade and a second slot on said sheath that receives therein said locating projections when said second edge of said blade is inserted into said first slot.

12. The folding knife of claim 10 further comprising a grip pivotably attached to said sheath by a first end wherein said first end of said grip has formed thereon a shearing seat that articulates with a shearing blade formed on said sheath to form a shears.

13. The folding knife of claim 12 wherein said leaf spring includes a second end that is elastically deformed by said grip when said grip is pivoted against said sheath.

14. The folding knife of claim 10 wherein said first and said second edge of said blade is sharpened.

15. The folding knife of claim 10 wherein said point extends beyond said handle when said blade is in a closed position.

16. The folding knife of claim 10 wherein said blade has at least one serrated edge.

17. The folding knife of claim 10 further comprising a locking projection on said blade that engages with said locking face.

18. The folding knife of claim 17 wherein said locking projection has a thickness less than the thickness of said locking face.

19. The folding knife of claim 10 further comprising an unlocking unit on said handle that engages with said unlocking face on said leaf spring.

20. The folding knife of claim 19 wherein said unlocking unit is selected from the group consisting of unlocking projections and lateral pins.

* * * * *